US008418284B2

(12) United States Patent
Bonac

(10) Patent No.: US 8,418,284 B2
(45) Date of Patent: Apr. 16, 2013

(54) DYNAMIC MATTRESS BASE

(76) Inventor: Tomo Bonac, Vancouver (CA)

( * ) Notice: Subject to any disclaimer, the term of this patent is extended or adjusted under 35 U.S.C. 154(b) by 0 days.

(21) Appl. No.: 13/395,338

(22) PCT Filed: Sep. 15, 2009

(86) PCT No.: PCT/CA2009/001294

§ 371 (c)(1),
(2), (4) Date: Mar. 9, 2012

(87) PCT Pub. No.: WO2011/032251

PCT Pub. Date: Mar. 24, 2011

(65) Prior Publication Data

US 2012/0167300 A1 Jul. 5, 2012

(51) Int. Cl.
*A47C 23/06* (2006.01)

(52) U.S. Cl.
USPC ..... 5/236.1; 5/238; 5/239; 5/241

(58) Field of Classification Search ..... 5/238, 236.1, 5/239, 241
See application file for complete search history.

(56) References Cited

U.S. PATENT DOCUMENTS

| | | | | |
|---|---|---|---|---|
| 3,252,170 | A | 5/1966 | Frye | |
| 3,717,376 | A | 2/1973 | Lutchansky | |
| 5,058,224 | A * | 10/1991 | Aschwanden et al. | 5/238 |
| 5,924,149 | A | 7/1999 | Weber | |
| 6,647,574 | B2 | 11/2003 | Weber | |
| 7,512,999 | B2 | 4/2009 | Caon | |

FOREIGN PATENT DOCUMENTS

| | | | |
|---|---|---|---|
| AT | 401606 | B | 10/1996 |
| CH | 663339 | A5 | 12/1987 |
| CH | 684779 | A5 | 12/1994 |
| DE | 19818172 | A1 | 10/1998 |
| WO | 8301563 | A1 | 5/1983 |
| WO | 8502987 | A1 | 7/1985 |

OTHER PUBLICATIONS

International Search Report for PCT/CA2009/001294, Completed by the Canadian Patent Office on May 14, 2010, 2 Pages.
Website www.flowsleeping.nl, With English machine translation, "Welcome to the world of Flow Sleeping", All together 2 Pages, Retrieved on Jun. 10, 2012.
Website http://www.nottinblu.itlhomelmain/PBS-R-Aktiva-System/Sistema-Aktiva-Kynetic, With English machine translation, "System Aktiva Kynetic", All together 2 Pages, Retrieved on Jun. 10, 2012.

* cited by examiner

*Primary Examiner* — Robert G Santos
*Assistant Examiner* — Brittany Wilson
(74) *Attorney, Agent, or Firm* — Brooks Kushman P.C.

(57) ABSTRACT

A base for bed mattress having a plurality of transverse slats, with each slat end attached to the frame of the base and pivotally connected to first end of a rod at the center of each slat is provided. The rod is attached at its second end to a dynamic pulley. The dynamic pulleys are connected by a common cord or flexible attachment running over stationary pulleys mounted between the slats to a central beam attached to the frame of the base. Improved distribution of human body support can thus be achieved independent of the contour and weight of the body at any sleeping position. Springiness of the base can be modified by changing the elasticity of the flexible attachment. The dynamic support base reduces the need for thickness of the mattress and of the bed pillow.

15 Claims, 5 Drawing Sheets

DYNAMIC MATTRESS BASE

CROSS-REFERENCE TO RELATED APPLICATION

This application is the U.S. national phase of PCT Appln. No. PCT/CA2009/001294 filed on Sep. 15, 2009, the disclosure of which is incorporated in its entirety by reference herein.

FIELD OF INVENTION

The present invention relates to a bed mattress base. More particularly this invention pertains to a mechanical self-adjusting mattress base that provides support for body contours.

BACKGROUND OF THE INVENTION

Present designs of mechanical sleeping systems typically include a combination of upper mattress and lower base. The mattress is usually thick foam or a system of inner springs. The aim of the mattress is to provide micro adaptability to the contour of the human body. The lower base supporting the mattress is typically a platform using transverse slats which act as simply supported beams.

The purpose of the mattress base is to provide for macro adaptability of the body not taken care by the mattress, as well as to elevate the mattress from the ground and to provide aeration of the mattress. The combined performance of the mattress and the base results in the largest mattress flexing/compression at the heaviest portion of the human body such as the hips and the shoulders. This leaves the lighter, concave portions of the body less supported. The most dramatic consequence of this arrangement is at the transition between the shoulders and the head, where the neck is essentially unsupported. This situation is remedied to some degree by using pillows of various shapes and firmness and by varying spring characteristics in the mattress or in the base slats, at the anticipated locations of improper body support. However, this approach fails whenever a person changes or modifies the sleeping position since a completely different body contour is associated with each body position while the body weight distribution stays the same. In addition, there is a large variation of body contour and weight distribution, even when the predominant side sleeping position is adopted, which could not be accommodated by the average spring properties of a mattress or a base.

Mechanical systems that self-adjust to the body contour rather than passively reacts to the body weight distribution are known. However, these systems are characterized by a limited capacity to compensate for the variation of the human body contour. CH 684779 discloses a system with interactive adjacent slats. When a slat is pushed downward it forces the adjacent slats upward by connecting the slats with a common belt or cord. U.S. Pat. No. 6,647,574 describes the interaction between adjacent areas of bed base surface in 3-D by employing wave springs. WO83/01563 describes the use of slats that are not attached at the ends to the frame and that interact with each other using a rope-sheath system comprising dynamic and stationary rope sheaths mounted between the slats and connected by a rope. U.S. Pat. No. 5,924,149 describes attachment of the ends of the slats to an elastomeric bridge suspension mounted to base frame.

Alternate systems are based on two pulley systems, each pulley system comprising a series of pulleys connected with a common cord and employing a guide rod that connects a pulley to the slat. These systems increase the capacity to compensate for the variation of the human body contour. For example U.S. Pat. No. 3,717,376 discloses a chair having two pulley systems, each pulley system is attached to the side-frame of the chair and comprises a series of pulleys. Each pulley is attached to one end of a rod that is guided within a bracket. The other end of the rod is attached to a slat that is free at each end so that the entire slat may move up or down. WO85/02987 describes the use of a two pulley system, each pulley system comprising rods guided in slides, and the rods are pivotally attached to slats. Each slat is free at the ends so that the entire slat may move up or down during use. CH 663339 describes a bed having two pulley systems, with each pulley system located within the sides of the bed frame. Each side of the bed frame comprises a series of slots, each slot guiding the vertical movement of a dynamic pulley. The ends of each of the slates are connected to the dynamic pulleys, and the slats rise and lower with movement of the dynamic pulleys. A similar arrangement is provided in U.S. Pat. No. 5,058,224 where the rods are guided in slots and cylinders located in the sides of the bed frame, and slats are pivotally attached to the dynamic pulleys. Patent AT 401606 describes slides for vertical guiding the rods. Each rod is pivotally attached to a slat, and each slat is free at each end. In several of the systems described above, both pulley systems need to rise and lower together in order to prevent the slats from jamming between the sides of the bed frame.

DE 19818172 describes the uses of movable plates (in place of rods) that run the width of the bed and that are attached to slats on their upper surface. Each plate comprises a linear bearing that is centrally located and interlaced with a cord to provide vertical guided movement of the slats. In U.S. Pat. No. 7,512,999 B2 a pulley system having vertical sliding pistons attached to dynamic pulleys at one end, and slats at the other, is shown. Each piston stem is surrounded by a spring. The slats may be slidably fixed to the bed frame at their ends.

Common to all of above inventions is the use of slats that are self-adjustable by mechanisms attached to the ends, or near the ends, of the slats and to the two opposing sides of the base frame. The arrangement of tandem mechanisms not only leads to an expensive solution, but is also difficult to use because of problems with mutual interference of the mechanism components, increased maintenance problems, movement noise, and an inconvenient design arrangement at the edge of the bed. It has proved difficult to design a bed having a thin mattress with a large range of movement at the edge of the base without interference with the bed frame. These systems still rely on the mattress to varying degrees to compensate for the human body weight and shape variation.

SUMMARY OF THE INVENTION

The present invention relates to a bed mattress base. More particularly this invention pertains to a mechanical self-adjusting mattress base that provides support for body contours.

It is an object of the invention to provide an improved dynamic mattress base.

According to the present invention there is provided a dynamic mattress base comprising,

- a frame having two frame sides and two frame ends and a beam positioned between the two frame sides, each beam end attached to each of the two frame ends; each of the two frame sides having a plurality of attachment points;
- a plurality of fixed pulleys attached to a side surface, and along the length of the beam;
- a plurality of flexible slats having a first and second end and an upper and lower surface, each of the first and second end of the slats attached to one of the two frame sides at the attachment points, each of the slats oriented perpendicularly to the length of the beam and elevated in respect to the beam, a plurality of rods having a first and second end, the first end of each of the rods pivotally connected to the lower surface of the slat at a position between the first and second end of the slat, the second end of each of the rods pivotally fixed to a dynamic pulley located adjacent to the fixed pulleys, each rod movable in a plane parallel to the length of the beam;

a flexible transmission member having two ends, each transmission member end attached to one of the beam ends or to one of the frame ends, and entrained in succession over and under the fixed and dynamic pulleys;

so that when a force is exerted against one or more of the slats, the slats, the rods attached to the slats, and the dynamic pulleys attached to the rods move in a direction of the force, the slats flexing in response to the force and moving the rods in a plane parallel to the length of the beam, and through the flexible transmission member, the force produces a corresponding movement in the slats, rods and dynamic pulleys that have not been subject to the force.

The present invention also provides the dynamic mattress base as defined above, wherein the flexible transmission member is selected from the group consisting of cord, belt, cable or chain. The cord may be elastic, such as polyurethane drive cord. In addition, one or more of the fixed pulleys may be spring-support mounted to the beam. Furthermore, the attachment points may be either a flexible attachment, a slidable attachment, or a combination thereof.

The dynamic mattress base as defined above may comprise rods that are not guided.

Furthermore, the slats may be made from extruded corrugated plastic.

The frame of the dynamic mattress base as defined above may also comprise two or more sub-frames, with one or more of the two or more sub-frames inclined relative to each other.

The present invention also provides a dynamic mattress base with a membrane comprising:

a frame having two frame sides and two frame ends and a beam positioned between the two frame sides, each beam end attached to each of the two frame ends; each of the two frame sides having a plurality of attachment points;

a plurality of fixed pulleys attached to a side surface, and along the length of the beam;

a membrane having sides generally fitting the frame, with two or more opposing sides of the membrane attached to the attachment points, the membrane having alternating thicker portions, and thinner flexible portions, the thinner flexible portions allowing twisting of thicker portions as well as lateral movement of thicker portions relative to each other, the thicker and thinner portions having an upper and lower surface and oriented perpendicular to the length of the beam and elevated in respect to the beam, a plurality of rods having a first and second end, the first end of each of the rods pivotally connected to the lower surface of the thicker portion at a position between the sides of the membrane, the second end of each of the rods pivotally fixed to a dynamic pulley located adjacent to the fixed pulleys, each rod pivotally movable in a plane parallel to the length of the beam;

a flexible transmission member having two ends, each transmission member end attached to one of the frame ends or one of the beam ends and entrained in succession over and under the fixed and dynamic pulleys;

so that when a force is exerted against a portion of the membrane, the membrane, the rods attached to the portion of the membrane and the dynamic pulleys attached to the rods move in a direction of the force, and through the flexible transmission member, produce a corresponding opposite movement in the membrane, rods and dynamic pulleys that have not been subject to the force.

The present invention also provides the dynamic mattress base with a membrane as defined above, wherein the flexible transmission member is selected from the group consisting of cord, belt, cable or chain. The cord may be elastic, such as polyurethane drive cord. In addition, one or more of the fixed pulleys may be spring-support mounted to the beam. The attachment points may be selected from the group consisting of one or more slot, one or more flexible attachment, one or more fastener, or a combination thereof.

The dynamic mattress base with a membrane as defined above may comprise rods that are not guided.

Furthermore, the membrane may be perforated.

The frame of the dynamic mattress base with a membrane as defined above may also comprise two or more sub-frames, with one or more of the two or more sub-frames inclined relative to each other.

The present invention overcomes drawbacks within the prior art by increasing the flexibility of the slats, or by providing a membrane having alternating thicker corrugated and thinner flexible portions, and by providing a single self-adjusting mechanism extending between the ends of the frame and located at or near the centre of the sides of the frame. The slats, or alternating thicker corrugated and thinner flexible portions of the membrane, are oriented transversely to the frame, and each slat or thicker portion of the membrane, is mounted at both ends to the frame side by flexible attachment allowing deflection or movement in all directions including rotational, about the axis of the slat, or the axis of the thicker portion of the membrane, up and down relative to the axis of the slate, or thicker portion of the membrane, and in a direction that is substantially parallel to the length of the slat, or thicker portion of the membrane. The centre of the slat, or thicker portion of the membrane, is pivotally attached on its lower surface to one end of a rod, the second end of the rod is pivotally attached to a pulley. The rod is not guided and when the slat, or membrane, is mounted to the frame, and the rod is allowed to pivot unobstructed in the plane perpendicular the length of the slat, and parallel to the beam.

The self-adjusting mechanism is incorporated in or on a beam mounted to the frame below the slats, or membrane, and comprises a series of pulleys fixed to the beam and interwoven with a flexible attachment, for example a cord, cable, chain, belt, or elastic cord, passed around the pulleys and attached at the ends to the beam or frame of the mattress base. The flexible attachment is entrained in succession over the fixed pulleys, rotationally attached to the beam, and under dynamic pulleys pivotally attached to a second end of the rods. The first end of the rods is attached to the lower surface of the slats or thicker portion of the membrane. A discrete downward flexing of a slat or membrane results in a corresponding upward movement of adjacent slats or portion of the membrane, flexing the adjacent slats or portion of the membrane, or both causing an upward movement and flexing adjacent slats or portion of the membrane.

The slats may pivot around their own longitudinal axis and, since each slat is supported at three points (two ends and the centre), they can be made very flexible without compromising the strength required to support for the weight of the human body. An improved adaptability to the body contour is thus achieved substantially independent of human body weight and weight distribution. Also since the rods are not housed within guides or slots, the manufacturing of the mattress base is less costly. Furthermore, the mechanism is quieter and smoother during sleep and may require less maintenance when compared to guided rods.

The flexible attachment may be selected from one of a series of cords, each characterized in having a different amount of elasticity. In this way, independent control of bounciness of the mattress base in the vertical direction may be obtained. The advantage is that customer preferences can be easily satisfied by using a cord with a different elastic property while maintaining unchanged adaptability of the base. Similarly, independent control if bounciness of the mattress base can be achieved by changing elasticity of the other base components. For example, the fixed pulleys mounted to the central beam can be individually spring-supported at their mount to the central beam. Also, the elasticity of the central beam can be changed and the ends of the central beam can be spring supported.

Another aspect of the present invention is that the weight and the manufacturing costs of the slats can be reduced due to the use of thinner slat characterized in exhibiting increased flexibility. The slats may be of any suitable material including wood, plastic, composite, metal, aluminium, spring steel or other flexible material. The slats may also be corrugated and manufactured using a plastic extrusion method. This invention is not limited to mattress base or slated design. For example, a single membrane may be used in place of the slats with the underside of the membrane pivotally attached to a plurality of spaced apart rods, at the first end of the rods. The membrane is characterized as having higher flexibility in the longitudinal direction of the base and lower flexibility in the transverse direction and would behave similarly as the plurality of slats.

The present invention provides a slatted base for a mattress with a self-adjusting mechanism which provides an improved support of the human body in any sleeping position. This slatted base allows for a reduction in the thickness of the mattress placed upon the base. The present invention results in reduced manufacturing costs, and in reduced interference and noise of the components of the self-adjusting mechanism.

The slatted base with a self-adjusting mechanism of the present invention also provides a range of self-adjustment in the distance that each slat can move thereby reducing the thickness of a pillow that would need to be used, and provides improved support of the cervical section of the vertebral column.

The slatted base with a self-adjusting mechanism of the present invention provides an independent control of the self-adjusting mechanism, for the modification of bounciness or damping of the mattress base.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

The present invention relates to a bed mattress base. More particularly this invention pertains to a mechanical self-adjusting mattress base that provides support for body contours.

The following description is of a preferred embodiment.

Figure 1:
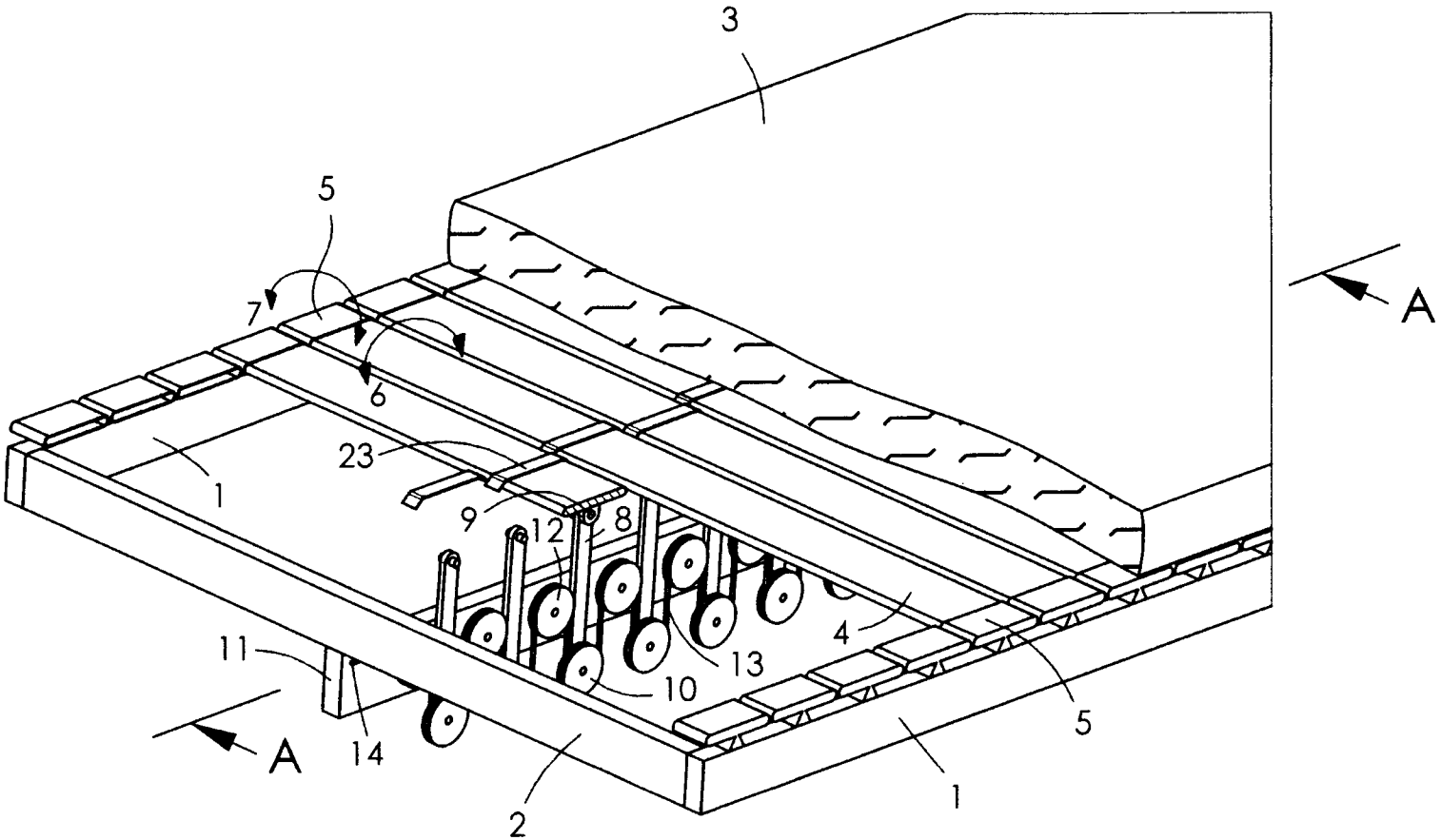
FIG. 1 shows a partial elevational perspective view of the base with the mattress in accordance with an embodiment of the present invention. Some slats are removed to make adjusting mechanism visible.

With reference to FIG. 1 there is shown a dynamic mattress base, The base may comprise a generally rectangular frame having sides 1 aligned with a longitudinal direction of the frame, and ends 2, which are perpendicular to sides 1. The shape and size of the frame are not to be considered to limit the invention in any manner. The frame may also comprise two or more sub-frames, with one or more of the two or more sub-frames inclined relative to each other. For example, an inner sub-frame may be inclined relative to an outer sub-frame. A mattress 3 when placed on top of the base is supported on the top region of the base by way of plurality of transverse slats 4 or a membrane (see 26 and 27 of FIG. 5, described below). A beam 11 is attached to the ends 2 of the frame and is positioned approximately centrally between the sides 1 of the frame.

Each slat comprises an upper and lower surface, and a first and second end, attached to a attachment points 5 mounted onto or positioned within the side 1. The attachments points may be flexible, or slidable, in a direction along the length of the slat, and permit movement of the slat in a variety of directions about the attachment point. It is preferred that the slat end not move in a vertical direction. For example, which is not to be considered limiting, the attachment point can be conveniently manufactured by injection moulding from an elastomeric material and the slat attached to the elastomeric material. The use of an elastomeric material permits movement of the end of the slat in a variety of directions, while still being attached to the side of the frame. Alternatively, the side may be made wholly or partially of an elastomeric material that comprises a plurality of the flexible attachment points to which the ends of the slats are attached. Elasticity of the flexible attachment points 5 assures that the slat end is able to pivot in all directions, for example around an axis along the length of the slat as indicated in the direction 6, or pivoting up and down, as indicated by the direction 7, and movement along the length of the slat, by compressing and extending the flexible attachment point. The compression-extension movement permits the slat to increase a bend deflection when a force is exerted onto the slat. In addition, by being attached to the side 1, by a flexible attachment point, the slat may also flex in a torsional manner as indicated by 6, thereby permitting the slat to flex in multiple directions and increase the comfort of the user when a force is exerted onto one or more slats. The slat may also be attached to the side of the frame using a slidable attachment that permits movement along the length of the slat within the attachment point. For example, the slidable attachment may comprise an opening within the side of the frame within which the end of the slat may slidably fit. The slat would be longer than the distance between the inside surfaces of the sides of the frame to permit slidable attachment while the slat is flexed upwards or downwards by a force. The slidable attachment be made in whole or in part, from an elastomeric material, the opening can be lined with an elastomeric material, the slidable attachment may also be made from a material with a low coefficient of friction, for example Teflon or other polymeric material, a plastic, or it may be an opening disposed within the side of the frame that is sized to receive an end of the slat. The use of a slidable attachment along with the flexibility of the slat, ensures that the slat is able to bend or twist in a torsional manner and flex in multiple directions to increase comfort for the user. The attachment points may also comprise a combination of flexible and slidable attachments.

If the frame may comprises two or more sub-frames, with one or more of the two or more sub-frames inclined relative to each other. For example, an inner sub-frame may be inclined relative to an outer sub-frame, the attachment points may be positioned on the inner sub-frame, the outer sub-frame, or a combination thereof. For example, the attachment points may be located on the inner sub-frame.

The lower surface of each slat is pivotally attached to a rod 8 using pivot 9, allowing free pivotal movement of each rod in a direction along the length of the beam, and free pivotal movement of each slat in direction 6. The rods are attached to the underside of the slats so that they are aligned within each other, in a direction parallel to the length of the beam. Each rod is also pivotally attached to a dynamic pulley 10, in any suitable manner, for example, it may be attached to one side of the dynamic pulley, or via a "U" bracket that attaches to both sides of the dynamic pulley 10.

Beam 11, is located underneath the slats and parallel to sides 1 and mounted at its ends to frame ends 2 for example as shown in FIG. 1. The beam may be attached to the frame ends 1 using any suitable method of attachment including a spring, or other flexible attachment, to permit movement of the beam relative to the ends 2 of the frame. Mounted along the length and to the side of beam 11 is a plurality of fixed pulleys 12 at approximately the same spacing as the spacing between the slats but off-set with respect to the slats thereby permitting the dynamic pulleys 10 and rods 8 to be placed between the fixed pulleys 12.

The fixed and dynamic pulleys are aligned in a row. To enable the self-adjusting function an transmission member, for example but not limited to a cord 13 is entrained, or interwoven, in succession over the fixed pulleys 12 and under dynamic pulleys 10. Each end 14 of the transmission member 13 is attached to one end of the beam, or frame end.

The combination of fixed pulleys, dynamic pulleys, and transmission member comprise the pulley system. In the dynamic mattress base described herein, one pulley system is utilized to interact with the flexible slats via one set of rods.

Since the forces acting on the transmission member are transmitted axially over the pulleys any vertical displacement of a slat in one direction causes the displacement of the remaining slats in the opposite direction. For example, when a force is exerted against one or more of the slats, for example if a human body is resting on the slats, the slats, the rods attached to the slats, and the dynamic pulleys attached to the rods move in a direction of the force, and through the flexible transmission member, produce a corresponding opposite movement in the slats, rods and dynamic pulleys that have not been subject to the force or are not subjected to the same amount of the force.

Figure 2A:
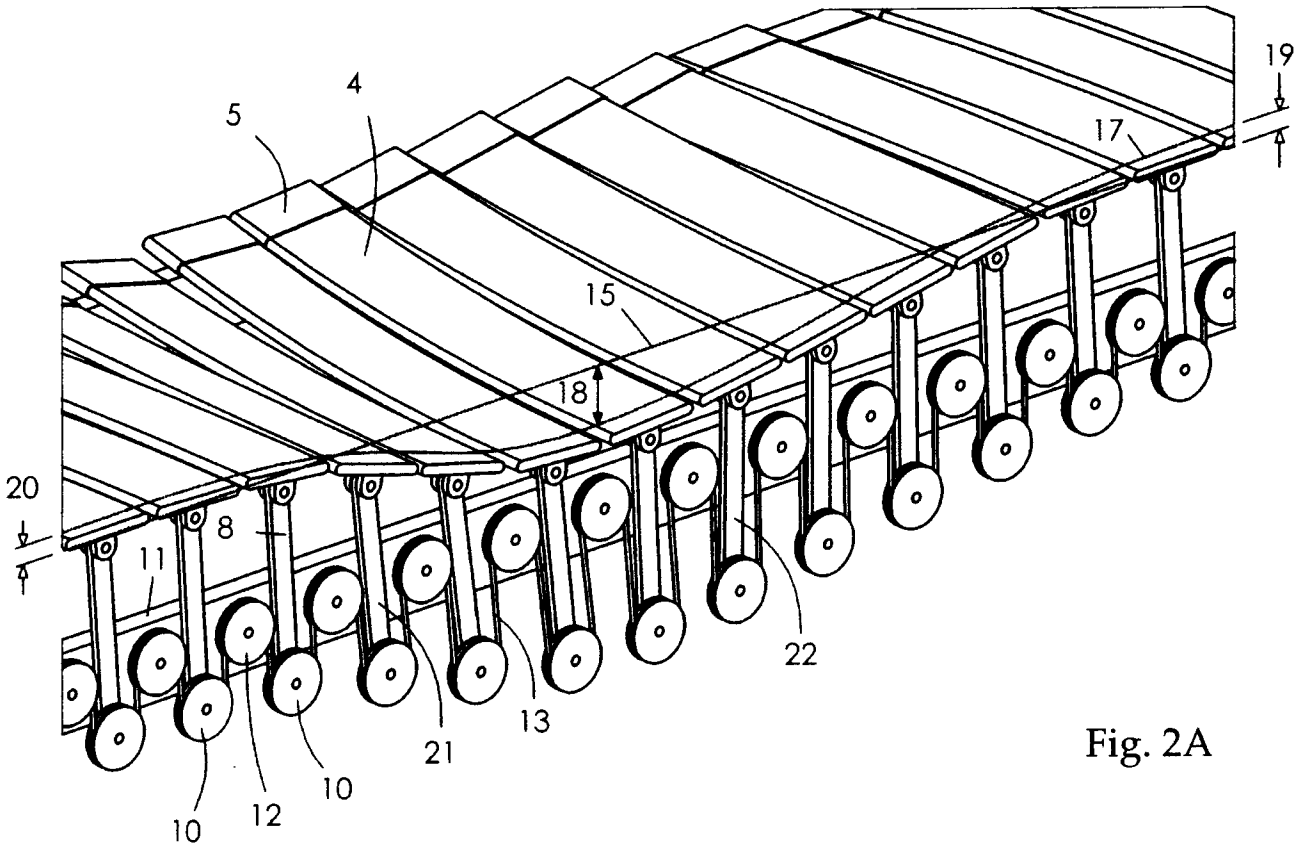
FIG. 2A shows a partial cross-sectional perspective view of the mattress base along lines A-A of FIG. 1, showing slats deflected by the human body contour. The mattress is not shown for clarity.
Figure 2B:
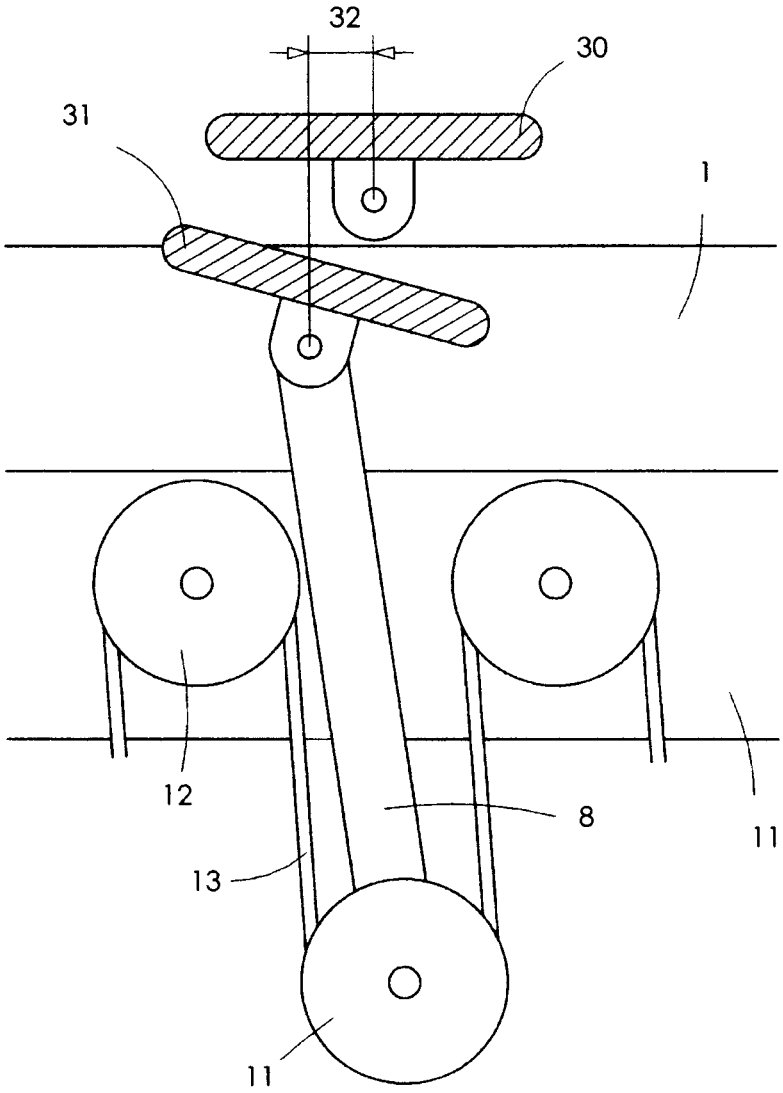
FIG. 2B shows a partial cross section of the pulley system and shows how the rod can move along the length of the beam if the slat is twisted about its axis.

FIG. 2A shows bending and torsional deflections of the slats in response to a force exerted on the slats, for example resulting from a human body (not shown). Line 15 in FIG. 2 depicts top surface of the slats of unloaded mattress base. The shape of the human body is presented by the curve 17. When the base is loaded by the human body its convex portion exerts a greater localized force on the slats and causes a slat deflection downward, as depicted by the maximum deflection 18. The portion of the flexible attachment 13 underneath the convex portion of the body is thus elongated. Since the flexible attachment 13 is attached at its ends to the end of the frame 2, at 14 the elongation of the flexible attachment 13 results in shortening underneath the concave portion of the human body causing slat deflection upwards, depicted by deflections 19 and 20. Because the slats are experiencing torsional deflection in addition to the bending deflection they tend to spread relative to each other at the place of larger deflections. This slat deflection causes pulleys 10 with rods 8 to assume an equilibrium position between fixed pulleys 12 which can be easily accommodated because the rods are pivotally attached and they are not guided (see FIG. 2B). The rods therefore, are able to pivotally move in a direction parallel to the length of the beam. This situation is shown in FIG. 2A where at the area of the largest slat deflection, the rods 21 and 22, as an example, are substantially not parallel to each other. FIG. 2B shows a detail of a rod 8 pivoting about the axis of the dynamic pulley 10, and in a plane parallel to the length of the beam, due to the torsional flexing of slat about its axis in direction 6 coupled with longitudinal flexing in a downward direction arising from a downward force, and producing an offset 32 between the position 30 of the unloaded slat, and position 31 of the of the loaded slat.

At the locations of the mattress base where the slats are deflected by a very steep transition from convex to concave portion of the human body, such as from shoulder to the neck, the slats might not be able to follow the body contour very well which would result in steps between adjacent slats. In order to smoothen such steps between the slats adjacent flat belts 23 may be woven between the slats (see FIG. 1). Alternatively, narrower slats may be used to decrease the size of potential step increments that may result between slats.

Figure 3:
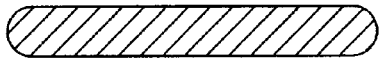
FIG. 3 shows a cross-sectional view of a slat made from a solid material.

The slats can be made from solid material such as wood, plywood, composite, plastic, metal, aluminium, or spring steel, and have a cross-section as shown in FIG. 3. For example, which is not to be considered limiting in any manner, a typical bending property of a 900 mm long slat, according to the present invention, may be from about 6 to about 15 mm bending deflection per 10 N force, for example 6, 7, 8, 9, 10, 11, 12, 13, 14, 15 mm or any amount therebetween bending deflection per 10 N force, or for example 10 mm bending deflection per 10 N force. However, it is desired that the slat be flexible in a torsional direction indicated by 6 as well as a bending direction along the length of the slat.

The slats that may be used in the dynamic mattress base as described herein are very flexible slats in comparison to the slats which are presently used by others for the conventional mattress base which, typically are characterized as exhibiting 1.5 mm deflection per 10 N force. The present invention permits the use of slats with increased flexibility since the pulley system with associate rods 8, are positioned on beam 11 and approximately centrally between the sides 1 of frame, thereby providing support mid-way along the length of the slat, and not just at the ends of the slats as described in the prior art. Using slats with increased flexibility, in combination with rods 8 that pivot in a direction parallel to the length of the beam that results from flexing of the slat, and optionally attachment of the slat to the sides 1 using flexible or slidable attachment points 5, the dynamic mattress base adapts to the body contour in a substantially improved manner compared to prior art systems. As a result, the thickness of the mattress 3 can thus be substantially reduced, typically to about 50 mm and still provide the same, or better, comfort to the user.

Figure 4:
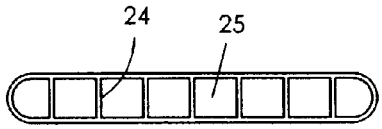
FIG. 4 shows a cross-sectional view of a slat made from an extruded corrugated plastic.

An alternative example of a construction of a slat is shown in FIG. 4. The slat depicted in FIG. 4 is made from injection moulded plastic, for example a corrugated plastic, and can have the same bending properties described above as for a solid slat but it may also have the additional advantage of increased torsional flexibility compared to a slat made of a solid material such as wood or plywood. Higher torsional flexibility of the slats would make the design slat attachments 5 simpler since the requirement for the slat to pivot in the direction 6 would be reduced. Therefore, using slats with increased flexibility, in combination with rods 8 that pivot resulting from flexing of the slat, the dynamic mattress base will adapt to the body contour in an improved manner compared to prior art systems, and permit reduction in the thickness of a mattress to about 50 mm and still provide the same, or better, comfort to the user.

The corrugated plastic slat in FIG. 4 has a plurality of vertical walls 24 creating a plurality of hollow cores 25 within the slat, but alternative deigns of corrugation are possible. For example, the slat core can be filled with co-extruded foam. The plastic slat may also be solid. Further advantages of corrugated injection moulded plastic slats are reduced manufacturing costs, recyclability and capability to be sterilized.

Figure 5:
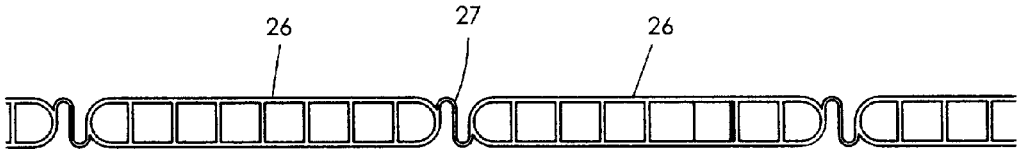
FIG. 5 shows a partial cross-sectional view of the membrane from extruded corrugated plastic according to alternative embodiments of the invention.

In another alternative of the present invention discrete slats can be replaced by a single membrane an example of which is shown in FIG. 5. The membrane may be formed by connecting thicker portions 26 of the membrane with flexible portions 27 of the membrane, in the same injection moulding process. The flexible features of the membrane would allow twisting of portions 26 and permit independent lateral movement of the thicker portions relative to each other. At the same time the thicker portions 26 would provide the same bending properties of the membrane as discrete slats. The membrane, either the thicker portion, the flexible portion, or both the thicker portion and the flexible portion can be perforated to allow aeration of the mattress. The thicker portion may be corrugated, a composite, with the core filled with co-extruded foam, or it may be solid.

The membrane maybe attached to the sides of the frame using any suitable attachment, for example which are not to be considered limiting, the attachment may be a fastener, including a plurality of blots, screws, snaps, hooks, clamps and the like, or a combination thereof, attached to the side and pass through openings in the membrane, the attachment may comprise a slot, or a plurality of slots, in the side 1 of the frame sized to accept an edge, or portions of an edge, of the membrane, or the attachment may comprise a slot or series of slots, either vertical or horizontal, to receive toggles, buttons, or other devices attached to the membrane that mattingly engage with the slots. The sides of the frame may be made of an elastomeric material. For example, which is not to be considered limiting, the attachment point can be conveniently manufactured by injection moulding from an elastomeric material and the membrane attached to the elastomeric material. Alternatively, the side may be made wholly or partially of an elastomeric material that comprises a plurality of flexible attachment points to which the side of the membrane are attached. The attachment may also comprise a combination of any of the above.

Figure 6:
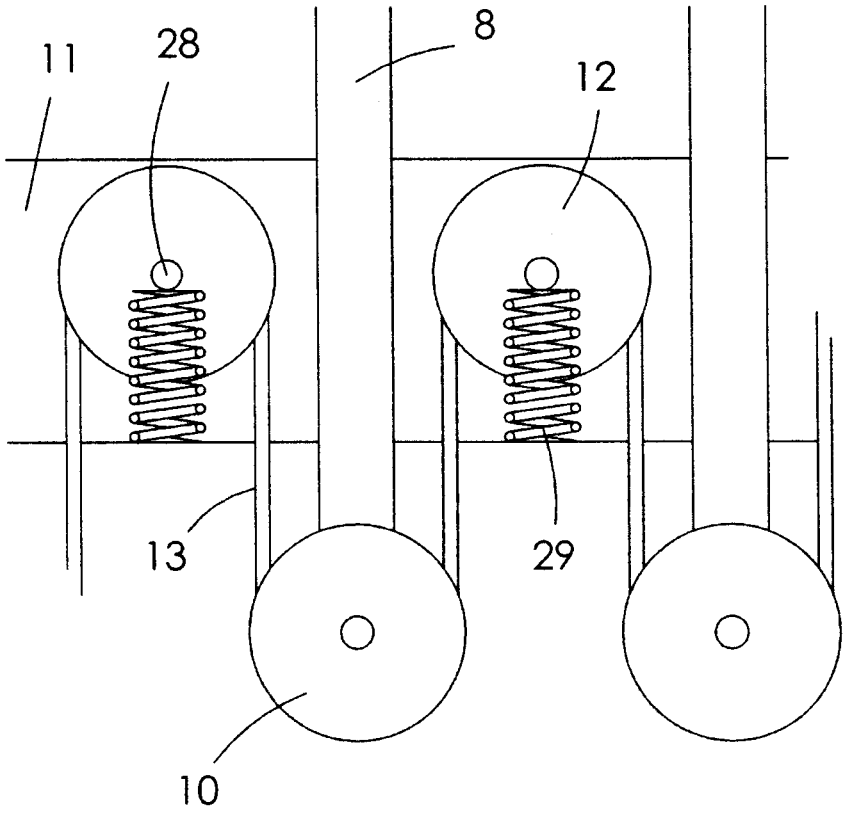
FIG. 6 shows a schematic partial view of the mattress base according to alternative embodiments of the invention.

FIG. 6 shows another alternative of the present invention where modification of mounting the pulley 12 to the beam 11 is used to adjust the comfort of a user. Instead of using pulley 12 permanently fixed as shown in FIG. 1 it is allowed to move in a vertical direction while its shaft 28 is being supported by the compression spring 29. The advantage of mounting the fixed pulley to the beam 11 using a spring-support is that the spring 29 would cushion a larger local force if the person decides to change the sleeping position abruptly.

The present invention is not limited to beds with one stationary mattress support. It can be applied also to beds with adjustable multiple articulated bed frame portions, powered or non-powered, without departing from the novelty principles inherent to the idea of this invention.

The present invention has been described with regard to one or more embodiments. However, it will be apparent to persons skilled in the art that a number of variations and modifications can be made without departing from the scope of the invention as defined in the claims.

What is claimed is:

1. A dynamic mattress base comprising:

a frame having two sides and two ends and a beam positioned between the two sides of the frame and attached to the two ends; each of the two sides having a plurality of attachment points;

a plurality of fixed pulleys attached to a side surface, and along the length of the beam;

a plurality of flexible slats having a first and second end and an upper and lower surface, each of the first and second end of the slats attached to one of the two sides at the attachment points, each of the slats oriented perpendicularly to the length of the beam and elevated in respect to the beam, a plurality of rods having a first and second end, the first end of each of the rods pivotally connected to the lower surface of the slat at a position between the first and second end of the slat, the second end of each of the rods pivotally fixed to a dynamic pulley located adjacent to the fixed pulleys, each rod movable in a plane parallel to the length of the beam; and a flexible interwoven attachment having two ends, each interwoven attachment end attached to one of the beam or frame ends, and entrained in succession over and under the fixed and dynamic pulleys;

so that when a force is exerted against one or more of the slats, the slats, the rods attached to the slats, and the dynamic pulleys attached to the rods move in a direction of the force, the slats flexing in response to the force and moving the rods in a plane parallel to the length of the beam, and through the flexible interwoven attachment, the force produces a corresponding movement in the slats, rods and dynamic pulleys that have not been subject to the force.

2. The dynamic mattress base of claim 1, wherein the flexible interwoven attachment is selected from the group consisting of cord, belt, cable or chain.

3. The dynamic mattress base of claim 2, wherein the cord is elastic, such as polyurethane drive cord.

4. The dynamic mattress base of claim 1, wherein the rods are not guided.

5. The dynamic mattress base of claim 1, wherein the attachment point is selected from the group consisting of a flexible attachment and a slidable attachment.

6. The dynamic mattress base of claim 1, wherein the slats are made from extruded corrugated plastic.

7. The dynamic mattress base of claim 1, wherein one or more of the fixed pulleys are spring-support mounted to the beam.

8. The dynamic mattress base of claim 1, wherein the frame is comprised of two or more sub-frames, with one or more of the two or more sub-frames inclined relative to each other.

9. A dynamic mattress base comprising:

a frame having two sides and two ends and a beam positioned between the two sides of the frame and attached to the two ends; each of the two sides having a plurality of attachment points;

a plurality of fixed pulleys attached to a side surface, and along the length of the beam;

a membrane having sides generally fitting the frame, with two or more opposing sides of the membrane attached to the attachment points, the membrane having alternating thicker portions, and thinner flexible portions, the thinner flexible portions allowing twisting of thicker portions as well as lateral movement of thicker portions relative to each other, the thicker and thinner portions having an upper and lower surface and oriented perpendicular to the length of the beam and elevated in respect to the beam, a plurality of rods having a first and second end, the first end of each of the rods pivotally connected to the lower surface of the thicker portion at a position between the sides of the membrane, the second end of each of the rods pivotally fixed to a dynamic pulley located adjacent to the fixed pulleys, each rod pivotally movable in a plane parallel to the length of the beam; and a flexible interwoven attachment having two ends, each interwoven attachment end attached to one of the frame ends and entrained in succession over and under the fixed and dynamic pulleys;

so that when a force is exerted against a portion of the membrane, the membrane, the rods attached to the portion of the membrane and the dynamic pulleys attached to the rods move in a direction of the force, and through the flexible interwoven attachment, produce a corresponding opposite movement in the membrane, rods and dynamic pulleys that have not been subject to the force.

10. The dynamic mattress base of claim 8, wherein the flexible interwoven attachment is selected from the group consisting of cord, belt, cable or chain.

11. The dynamic mattress base of claim 9, wherein the cord is elastic, such as polyurethane drive cord.

12. The dynamic mattress base of claim 8, wherein the rods are not guided.

13. The dynamic mattress base of claim 1, wherein the attachment point is selected from the group consisting of a flexible attachment and a slidable attachment.

14. The dynamic mattress base of claim 8, wherein membrane is perforated.

15. The dynamic mattress base of claim 1, wherein the frame is comprised of two or more sub-frames, with one or more of the two or more sub-frames inclined relative to each other.

* * * * *